United States Patent [19]

Deffner et al.

[11] Patent Number: 4,841,800

[45] Date of Patent: Jun. 27, 1989

[54] ADJUSTABLE CONTROL LEVER

[75] Inventors: Gary W. Deffner, Arvada; Thomas R. Goldberg, Golden, both of Colo.

[73] Assignee: Ampex Corporation, Redwood City, Calif.

[21] Appl. No.: 23,412

[22] Filed: Mar. 9, 1987

[51] Int. Cl.[4] ..... G05G 5/06

[52] U.S. Cl. ..... 74/531; 74/426; 74/527; 74/523

[58] Field of Search ..... 74/473 R, 523, 526, 74/142, 34, 372, 569, 519, 530, 527, 531, 501 D; 308/DIG. 9

[56] References Cited

U.S. PATENT DOCUMENTS

| | | | |
|---|---|---|---|
| 1,689,538 | 10/1928 | Volkerding . | |
| 2,242,327 | 5/1941 | Rubinstein . | |
| 2,703,499 | 3/1955 | Reid . | |
| 2,762,234 | 9/1956 | Dodd . | |
| 2,802,374 | 8/1957 | Reid . | |
| 2,842,645 | 7/1958 | Dakgleish et al. . | |
| 2,842,647 | 7/1958 | Khouri | 74/526 |
| 2,904,766 | 9/1959 | McMillan . | |
| 3,308,675 | 3/1967 | Jonsson . | |
| 3,350,957 | 11/1967 | Morse | 74/523 |
| 3,365,975 | 1/1968 | Hathaway . | |
| 3,372,359 | 3/1968 | Wilson . | |
| 3,477,057 | 11/1969 | Bang . | |
| 3,482,465 | 12/1969 | Lusted | 74/523 |
| 3,504,326 | 3/1970 | Campbell . | |
| 3,525,272 | 8/1970 | Olson | 74/530 |
| 3,534,242 | 10/1970 | Skirpan . | |
| 3,545,415 | 12/1970 | Mori | 74/569 |
| 3,629,775 | 12/1971 | Kindred . | |
| 3,863,520 | 2/1975 | Moline et al. | 74/526 |
| 3,972,017 | 7/1976 | Dohanic . | |
| 3,983,270 | 9/1976 | Licari et al. | 427/372 |
| 4,136,211 | 1/1979 | Sliney | 427/34 |
| 4,225,295 | 9/1980 | Shimizu et al. | 418/142 |
| 4,471,564 | 9/1984 | Beny | 74/526 |
| 4,507,601 | 3/1985 | Andresen | 74/523 |
| 4,515,033 | 5/1985 | Carlo | 74/473 R |
| 4,527,682 | 7/1985 | Gale | 74/526 |
| 4,622,861 | 11/1986 | Hill . | |

FOREIGN PATENT DOCUMENTS

| | | | |
|---|---|---|---|
| 615879 | 6/1978 | U.S.S.R. | 74/523 |
| 594986 | 11/1947 | United Kingdom | 74/526 |
| 695195 | 8/1953 | United Kingdom | 308/DIG. 9 |
| 706795 | 4/1954 | United Kingdom | 308/DIG. 9 |
| 866462 | 4/1961 | United Kingdom | 74/501 D |
| 953409 | 3/1964 | United Kingdom | 74/526 |

*Primary Examiner*—Richard E. Moore
*Assistant Examiner*—Vinh Luong
*Attorney, Agent, or Firm*—Harry G. Thibault; Richard P. Lange

[57] ABSTRACT

A pivotable control level disposed between a pair of spaced plates, with a motion resisting element mounted on the lever and compressed by the plates to provide a constant resistive force or "feel" to the system operator. A separate adjusting mechanism selectively increases or decreases the amount of compression exerted by the plates on the element to either increase or decrease the resistive force felt by the operator.

11 Claims, 4 Drawing Sheets

ADJUSTABLE CONTROL LEVER

The present invention relates to electronic signal control and in particular to an adjustable control lever usable in a video control console of a video switching system, or switcher.

A finished video presentation is usually a series of short scenes assembled through an edit process. Unlike motion picture film which is edited by physically cutting and splicing film segments together, video material is edited by electronically cutting and splicing together segments of video signals.

A video switcher is an electronic device which is known in the art and used to edit video material from a variety of sources to assemble a finished video presentation. Video material is provided to the video switcher as input video signals from a variety of video sources. The video switcher typically selects for presentation as an output video signal one or more of the input video signals, by switching from the source of one input video signal to the source of another signal, with the time of occurrence controlled by a switcher operator. This output video signal can be recorded by a video tape recorder, displayed on a video monitor, or broadcast to viewers.

For a detailed discussion of the video switcher and switching techniques see *Television Engineering Handbook*, K. Blair Benson, McGraw-Hill, 1986, pp. 14.65 to 14.76.

The mixing of video signals by the video switcher is facilitated by a control mechanism designated as a fader mechanism. In some cases the fader mechanism is automatic, e.g., digital, and a switcher operator selects inputs which choose the form of the step chosen for a specific switching technique as well as control the timing and/or intensity for the mixing of the first and second video input signals to generate a combined output signal by pressing a button on the switcher panel. Or the fader mechanism can be manual, comprising a moveable element, such as a lever, having a handle controlled by the operator who controls the mixing of the first and second video input signals with the operating handle. In a manual fader mechanism it is desirable that the fader element has an inherent and consistent resistive force enabling the operator to positively control the position of the handle throughout its path of movement.

Such positive and precise positional control of the handle has commonly been designated as "feel" by users of video switcher systems. Although prior fader mechanisms have been designed to provide desirable "feel" to the operator, shortcomings in such designs have produced inconsistent resistive forces from unit to unit and required multiple adjustments, e.g., a known belt-driven mechanism could not consistently provide the "feel" desired by the operator.

In the known belt-driven mechanism a first driven toothed gear is mounted for driving engagement of a rotary potentiometer shaft and connected by a drive belt to a second driving toothed gear which is operatively connected to the control lever. Slippage and wear in such a mechanism occur not only in the driving gear, but also in the driven gear and in the belt, making the slippage problem difficult to correct in the known design. Further, in the known device the shaft of both the driving gear and the driven gear are mounted on one side of the mechanism, and the gears have a pronounced tendency to bind under belt tension. Also, the mechanism is bulky, i.e., wide, with a multiplicity of parts, to severely complicate both manufacture and assembly.

Another known control mechanism provides a control lever connected directly to the potentiometer shaft such control lever extending beyond the potentiometer shaft connection to carry, at an inner end, a spring mechanism having opposite ends which push into engagement with the side walls. Such mechanism is unreasonably bulky, i.e., wide, to accommodate the springs and the detents associated therewith and also includes a multiplicity of parts which unnecessarily complicates manufacture, assembly and even routine adjustment of the control device.

In a control mechanism, it is highly desirable to provide a highly precise and positive positional control associated with the rotating lever of that mechanism, particularly when the mechanism can deliver a constant resistive force or "feel" to the operator through such lever.

The subjective concept of "feel" is particularly important in the environment of video switching systems and apparatus. The multiple switches provided on the face of a video switching console provide the only interface between the switching system and the operator. The operator uses those switches hundreds of times a day to derive the desired output from the signals passing through the console of the switching system. Consequently, such an operator tends to focus on the nature of the "feel" that he derives from the moveable elements of the fader mechanism provided with the system. Thus a fader mechanism that provides a constant resistive force throughout the throw of movement for the moveable element, to precisely and positively control the position of that element, a fader mechanism which permits its moveable element to be adjusted to provide for each operator the "feel" that is most comfortable to him, is a highly desirable mechanism.

Further advantages accrue to such a control mechanism if it is simple to manufacture and assemble, inexpensive and structurally simple. If the device is also substantially less bulky than known structures, particular constructional advantages enure to a designer incorporating such features, e.g., simplicity and economy of design, and lower manufacturing costs based on fewer and simpler parts. It is particularly desirable if the resistive force of such mechanism is consistent from unit to unit. Further, the mechanism should have a high degree of reliability to eliminate or drastically reduce in-service failures, and most importantly the mechanism should provide a desirable "feel" to the operator of the system. Such a control mechanism can be used in any industrial system which uses an extremely precise and sensitive control mechanism. Applications other than video switching include audio, hydraulic, pneumatic and robotic systems.

Accordingly, the present invention provides a control mechanism having an adjustable lever supported by at least one plate for rotation in a plane generally parallel to said plate. A handle is provided at the outer end of the element. A glide element is captured within said element to extend beyond the side of the lever facing the plate.

The glide element is mounted to engage the facing side of the plate under slight compression, to provide a constant resistive force as the lever is rotated from one end to the other of its required travel. The glide element, under slight compression, acts as a damped spring, and can be considered a precision fixed-force brake.

It is also desirable to easily vary the amount of compression at the glide element and in the preferred embodiment of the present invention the glide element is captured in a compressible ring at an inner end of the control element. As the diameter of the compressible hole is reduced, the perpendicular force of the glide element against the surface of the plates is increased and the net resistive drag is increased. The compressive drag can thus be adjusted to customize the "feel" in the control mechanism to the specific needs of an individual operator.

BRIEF DESCRIPTION OF THE DRAWINGS

A better understanding of the invention can be obtained by considering the following detailed description together with the accompanying drawings which illustrate a preferred embodiment and additional embodiments of the present invention as used in a video switching system in which.

DETAILED DESCRIPTION

Figure 1:
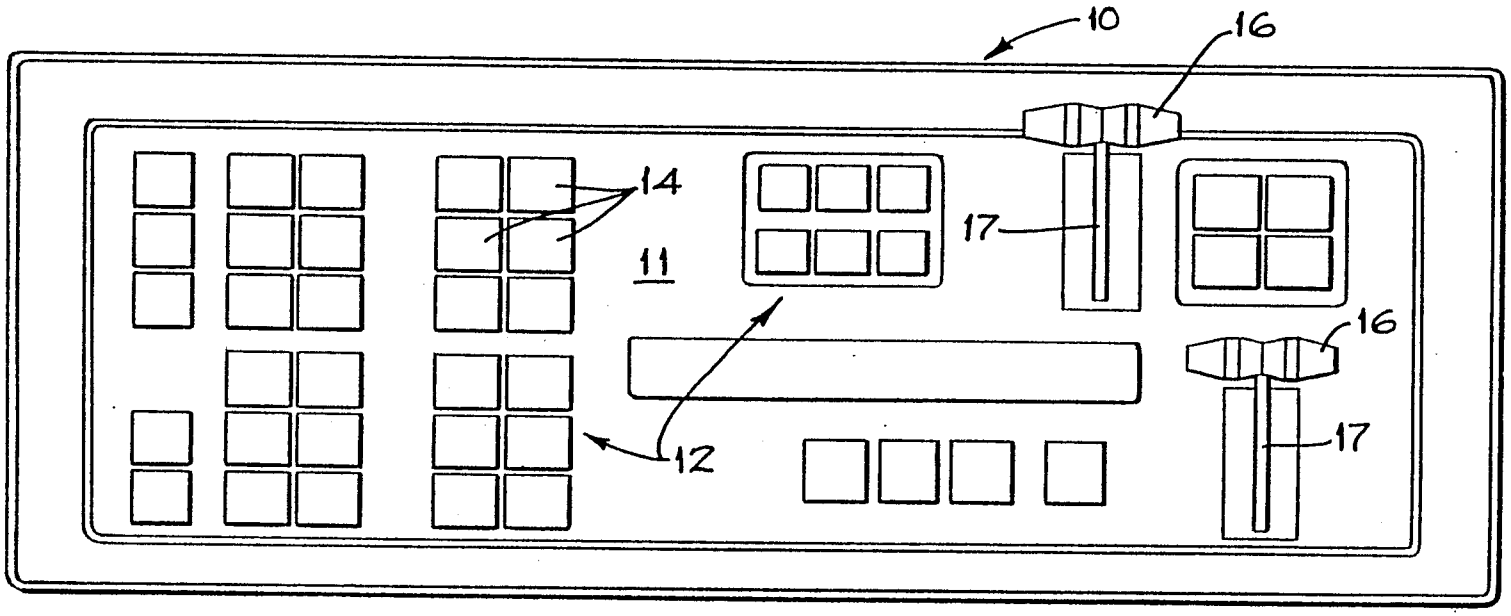
FIG 1 is an orthographic view of the front control panel of a video switching system, in which the control mechanism of the present invention can be seen as handles extending outwardly from that control panel.
Figure 1A:
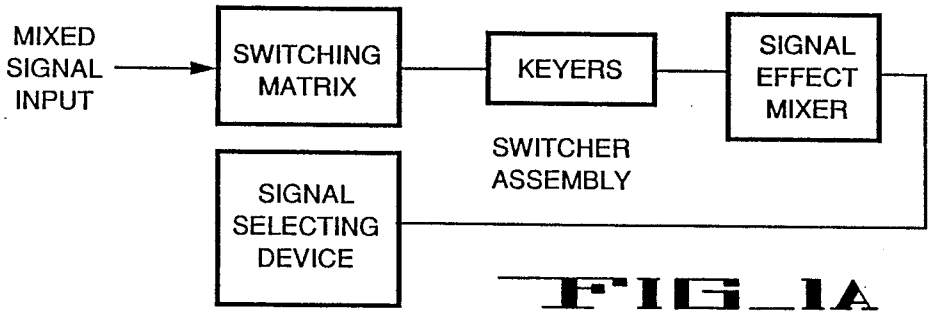
FIG. 1A is a block diagram showing the signal processing sequence of a typical switcher.
Figure 3:
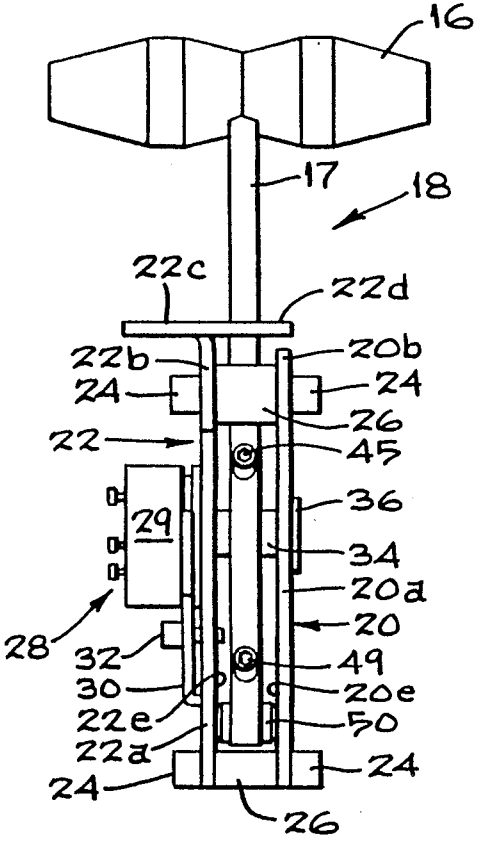
FIG. 3 is a view taken along the lines 3—3 of FIG. 2.
Figure 2:
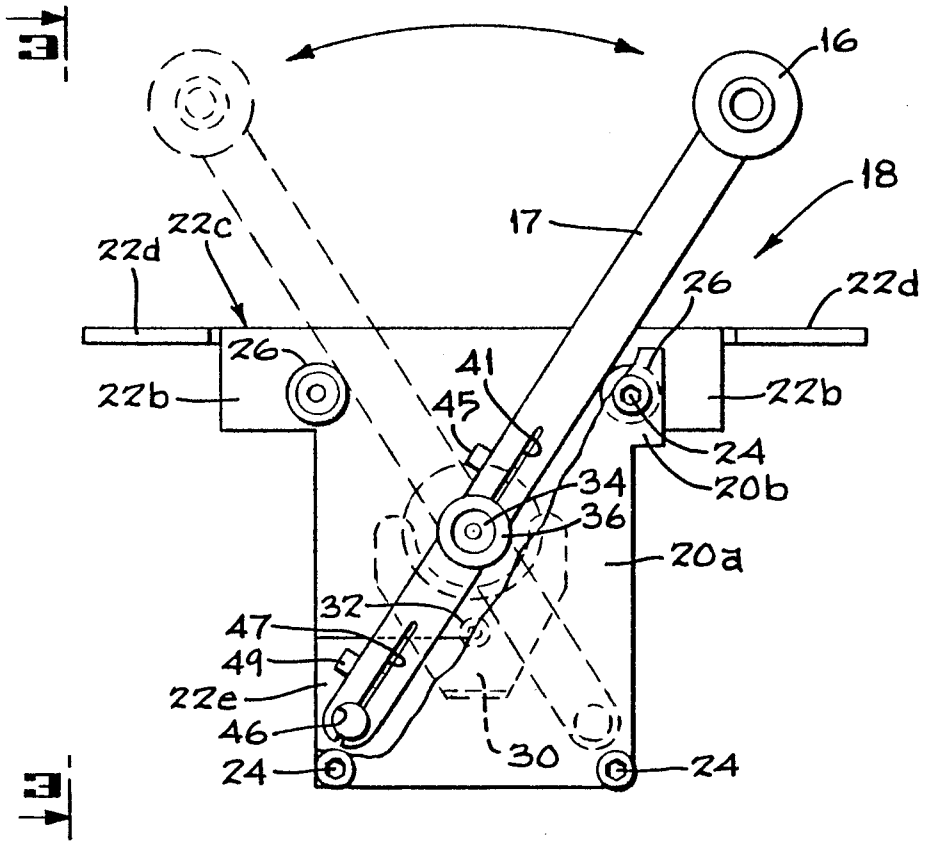
FIG. 2 is a side elevation of the preferred embodiment of the control mechanism of the present invention.
Figure 4:
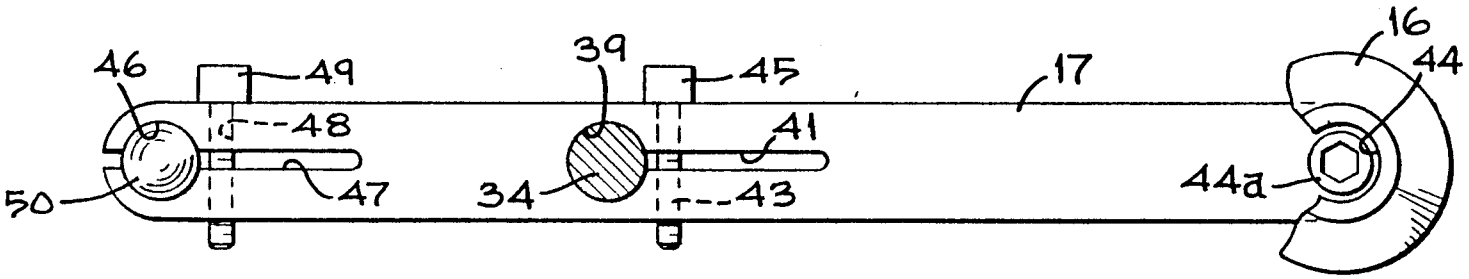
FIG. 4 is a side elevation of the control lever of the mechanism of FIG. 3.
Figure 5:
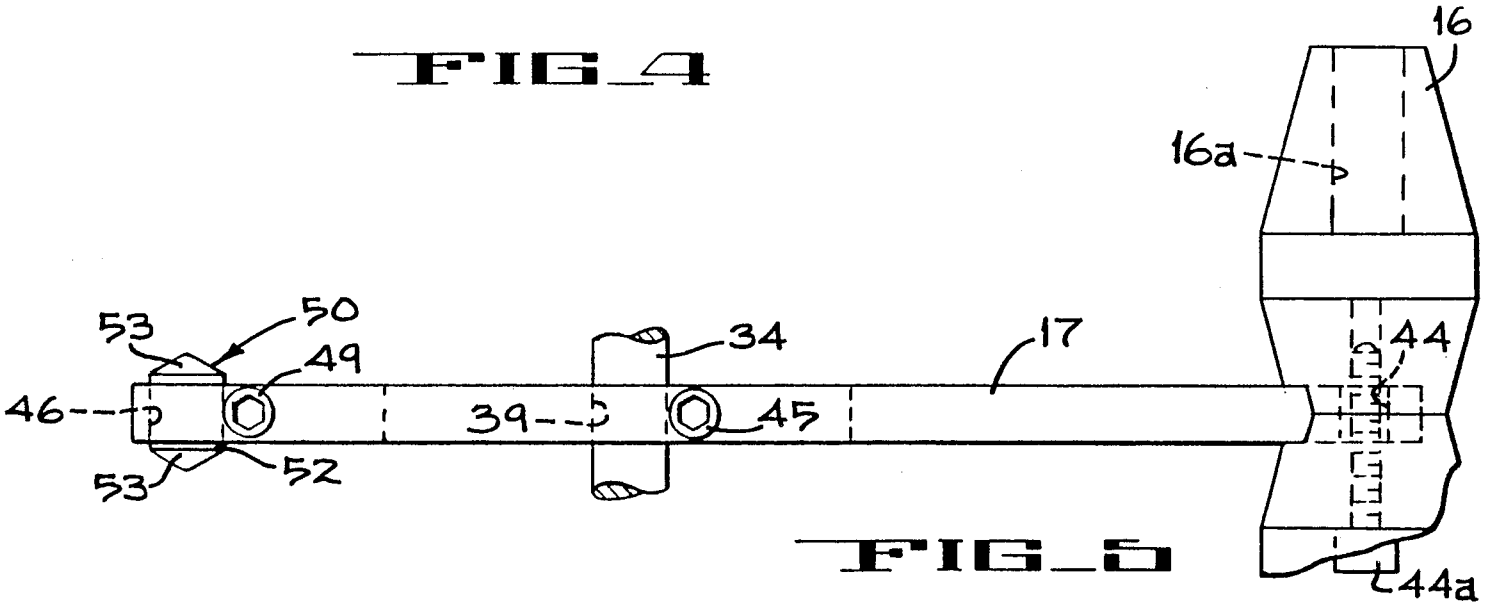
FIG. 5 an plan view of the control lever shown in FIG. 4.

Referring first to FIG. 1, a video switcher system 10 having a console 11 comprises a highly complex system for controlling video signals. The interface between the console 11 and the operator is a control panel 12 which includes system control means such as buttons 14 or operating handles 16. The function of an operating handle might best be described by example. An operator can use the buttons 14 to select the parameters which he desires to use in order to mix one signal input with another. Then the handle 16 can be moved from one end of its rotary travel to the opposite end of its rotary travel to control the mixing of multiple signal inputs to produce a mixed signal output.

In a typical switcher assembly for manipulating the video signal, a mixed signal input is applied to a switching matrix, to be output therefrom to keyers and signal effect mixers which process the signal output, with a signal selecting device selectively combining the mixed signal output of the mixers.

In one instance the signal output of the switcher is a sequence described as a "fade", in which, in a combined signal output, a first signal fades from its original intensity to zero as a second signal simultaneously gains in intensity from zero to an output level equal to the original intensity of the first signal, from one end to the other of the throw of movement for the handle 16. A second sequence is a vertical "wipe" in which a horizontal line moves across the video signal output displayed on a monitor from top to bottom, switching from a first to a second signal input, to replace one signal with the other, line by line across the entire video field. In achieving special effects like those noted above, it is highly desirable that the manual positioning of a control lever 17 associated with the handle 16 be very stable and precisely controlled to provide a constant resistive force for the operator to enable him to subjectively "feel" the position of the signal output which he controls through the control lever 17. The electronic circuitry which achieves the special effects described above is beyond the scope of this invention.

The present invention relates to a control or fader mechanism 18 shown in FIGS. 2–5 which is controlled by the handle 16. It is necessary only to discuss one of the mechanisms 18 taken from the console 10 since all are similar and the description of one would be the description of all.

The fader mechanism 18 comprises two plates 20 and 22 joined together by four screws 24 provided adjacent upper and lower edges of each of the plates 20 and 22, the screws 24 received in spacers 26 which define the lateral separation between the plates 20 and 22. The plates 20, 22 have relatively rectangular main body portions **20*a*, 22*a* with lateral extensions 20*b*, 22*b* provided at the upper ends thereof. The upper lateral extension 22*b* of plate 22 is somewhat longer than the extension 20*b* and terminates in an elongated flange 22*c* which extends beyond the upper edge of extension 22*b* and is bent to be perpendicular to the plate 22 and extend away from the plate 20. Cuts made at opposite ends of the extension 22*b* produce flange extensions 22*d* at opposite ends of flange 22*c* and which extend in the opposite direction of flange 22*c* to terminate at the outer face of the plate 20**.

A rotary potentiometer 28 is supported on the outside of the plate 22 and somewhat above the approximate center thereof by a potentiometer clip 30 which engages the potentiometer 28 and is held in place by a screw 32 which is attached to the plate 22. The potentiometer 28 includes a shaft 34 which extends through the plate 22 to engage a bushing 36 mounted in the plate 20 opposite a potentiometer body portion 29. The control lever 17 has an opening 39 (FIG. 4) which receives the potentiometer shaft 34 to rigidly mount the shaft 34 for movement therewith as the control lever 17 rotates between end positions defined by opposite upper spacers 26 which separate upper body portions **20*a*, 22*a* of the plates 20, 22**.

The control lever 17 is mounted on the potentiometer shaft 34 so that about two thirds of the control lever 17 extends outwardly from the potentiometer shaft 34 and the opening 39 and one third of the control lever 17 extends inwardly. Extending upward from the opening 39, along the longitudinal axis of the control lever 17, is a slot 41. Disposed in the slot area 41 is a threaded opening 43 which passes through the control lever 17 and both sides of the slot 41 and is perpendicular to the axis of the opening 39 and adjacent to the opening 39 as well. A screw 45 is threaded into the opening 43 to rigidly mount the control lever 17 on the shaft 34. The slot 41 should be long enough to enable to screw 45 to rigidly clamp the control lever 17 to the shaft 34. In the preferred embodiment, the slot 41 is somewhat longer than one-half inch. At the outer end of the control lever 17 is provided a threaded opening 44 which aligns with an opening 16*a* in the handle 16. A threaded fastener 44*a* is inserted into the opening 16*a* in the handle to engage the opening 44 and secure the handle 16 to the control lever 17.

A circular opening 46 is provided at the lower end of the control lever 17. A slot 47 extends along the longitudinal axis of the control lever 17, from the inner end thereof to a point about one-half inch inboard of the edge of the opening 46 which is adjacent the inner end of the control lever 17. Perpendicular to the axis of the opening 46 and inboard of the inner edge of the opening 46 is a threaded opening 48 which passes through the control lever 17 and both sides of the slot 47 and receives a screw 49. Mounted in the opening 46 at the inner end of the control lever 17 is a glide element 50 formed of an elastomeric material, such as polyurethane, which may contain an anti-friction substance, such as a 6% silicone impregnation, as in the preferred embodiment. The slot 47 should be long enough to enable the screw 49 to squeeze the control lever 17 to compress the glide element 50.

The glide element 50 comprises a cylindrical body portion 52 having conical outer ends 53. The glide element 50 is positioned in the opening 46 to extend equally from opposite sides of the control lever 17 to minimize binding of the lever 17 against inner faces 20*e*, 22*e* of the plates 20, 22. The fastener 49 is tightened to secure the glide element 50 to the control lever 17. Thus the glide element 50 provides a simple one-piece element easily installed in the control lever 17.

The respective lower inner faces 20*e*, 22*e* of plates 20, 22, on which the path of the glide element 50 is traced, are coated with an anti-friction material to engage the glide element 50 and enable it to smoothly move between the faces 20*e* and 22*e* in frictional engagement therewith so as to provide "feel" to the operator. Typically, a fluorocarbon polymer such as PTFE is used for the coating. However, it has been found that with a suitable finish (matte), epoxy, nylon, polyester powder-coat plastic paint or a similar material could be substituted for the fluorocarbon polymer. In addition the spacing between the plates 20 and 22 allows the glide element 50 to be axially extended against the opposite faces 20*e*, 22*e* of the plates 20 and 22.

Thermoplastic or rubber material could also be used for the glide material in lieu of the thermosetting materials described above. This could be done as a cost reduction measure since thermoplastic elastomers can be fabricated using high speed injection molding or reactive injection molding (RIM). However, if devices of this type were produced, they would not perform as well as a function of extended time periods or in harsh environments.

Another alternative is to forego coating the plates 20, 22 and apply a lubricant to the glide element 50. However, the use of a lubricant on the glide element 50 creates problems not inherent in the present fader mechanism 18, including the need to repeatedly lubricate the glide element 50 and the need to provide access to the glide element 50 for such lubrication.

In the installed position, the control lever 17 is equispaced from side plates 20, 22 of the fader mechanism 18. The plates 20, 22 slightly compress the glide 50 to enable the lever 38 to provide a tactile "feel" when moved by an operator of the switcher system. The screw 49 may be adjusted to increase or decrease the compression on the glide element 50 to simply and incrementally extend or retract the glide element 50 axially between the plates 20, 22. The control mechanism 18 presents a relatively narrow profile, seen best in FIG. 3. Additional advantages, including simplicity of construction and design are also evident in the drawing.

The operation of the fader mechanism 18 is as follows. The control lever 17 is movable from an engaging position with the first stop 26 to an engaging position with the opposite stop 26 by a rotary motion. The handle 16 is grasped by the operator to smoothly move the control lever 17 from a first position to a second position. Movement of the control lever 17 rotates the potentiometer shaft 34 to control the mixing of first and second signal inputs to the switcher 10. As the handle 16 moves the control lever 17, the glide element 50 moves between the two coated faces 20*e*, 22*e* of the plates 20, 22. Because the plates 20, 22 hold the glide 50 under compression, the glide element 50 resists the input of the operator through the handle 16 and thereby provides "feel" to the operator. Such resistance also enables the operator to stop the control lever 17 in a holding position at any intermediate point between the end stops 26. Further, slot 47, adjacent the opening 46 can be narrowed by further threading the fastener 49 in the opening 48 to draw opposite sides of the lower end of the control lever 17 together to compress the glide element 50. Compressing the glide element 50 in this manner pushes its opposite ends 53 outward toward the plates 20, 22 to increase the resistance of the control lever 17 to movement. Thus the fastener 49 can be adjusted to vary the resistance of the control lever 17 to movement and thus vary the amount of "feel" transmitted to the operator. Such an adjusting mechanism also allows the operator to select the amount of "feel" desirable to him, a highly important feature to the operator of a system using such mechanism, for the reasons discussed above.

Figure 6:
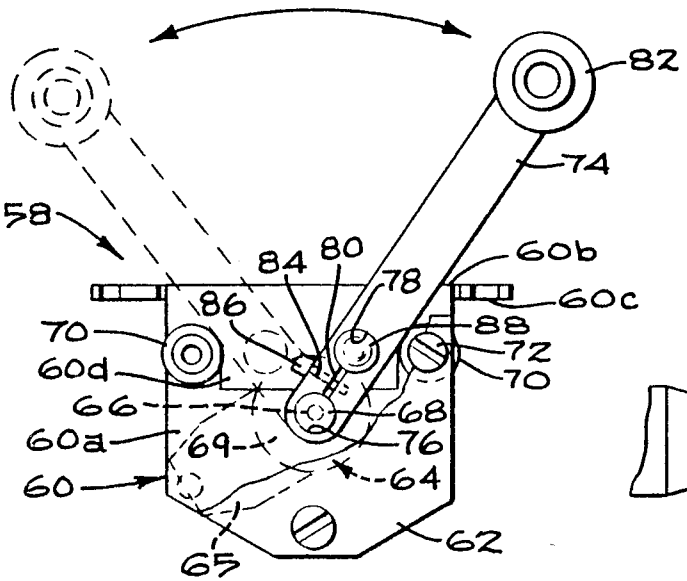
FIG. 6 is a side elevation of a second embodiment of the control mechanism of the present invention, with thereof removed for clarity.

In FIG. 6, a second embodiment of the present invention is shown. The fader mechanism 58 is similar to the mechanism 18 in many respects as far as componentry is concerned. However, a substantial effort has been undertaken to reduce the size of the mechanism 58, as compared to the mechanism 18. Side plates 60, 62 are much smaller than side plates 20, 22. Only three spacers 70 separate the plates 60, 62, with screws 72 passing through each of the side plates 60, 62 to hold the spacers 70 in place. The main body portion 60*a* of side plate 60 is generally rectangular with a slightly rounded lower end. The upper end of the main body portion 60*a* of plate 60 terminates in an longitudinal flange 60*b* which is bent to be perpendicular to the plate 60 and extend away from the side plate 62. Cuts made at opposite ends of plate 60 produce flange extensions 60*c* at opposite ends of flange 60*b* and which extend in the opposite direction of flange 60*b* and toward the side plate 62 which has a generally rectangular main body portion 62*a* that is similar in shape to the main body portion 60*a* of the plate 60. A rotary potentiometer 64 is mounted on the outside of the plate 60 by a potentiometer clip 65, with a potentiometer shaft 66 extending through the wall 60 to be received in a bushing 68 mounted in side plate 62 opposite a potentiometer body portion 69.

A control lever 74 has a circular opening 76 at an inner end, a second circular opening 78 outward thereof, and a longitudinal slot 80 extending therebetween and generally along the axis of the control lever 74. A handle 82 is rigidly mounted at the outer end of the lever 74 in a manner similar to the mounting of the handle 16 to the control lever 17. A threaded opening 84, passing through the lever 74, is provided between the openings 76 and 78 and generally perpendicular thereto, and receives a screw 86.

The potentiometer shaft 66 is received in the opening 76. A glide element 88, similar in all respects to the glide element 50, is mounted in the opening 78, to be disposed between the pivot axis (potentiometer shaft 66) of the control lever 74 and the handle 82. The screw 86 can be adjusted to adjust the "feel" of the lever 74. Upper spacers 70 act as stops at opposite ends of travel for the lever 74.

The upper inner faces 60*d*, 62*d* of plates 60, 62 are coated with an anti-friction material to trace the path of the glide element 88. The material and manner of coating are similar to those for plates 20, 22 of control device 18. Further, the operation of the fader mechanism 58 is similar to the operation of the fader mechanism 18. There is no need to amplify on the similarities between the two mechanisms 18, 58. In point of difference, fader mechanism 58 shows that the basic device can be substantially reduced in size and still provide similar features and similar performance. More importantly, fader mechanism 58 shows that the position of the glide element is not limited to a specific configuration and the glide element may attach to the lever in other geometries on either side of the pivot point.

Figure 7:
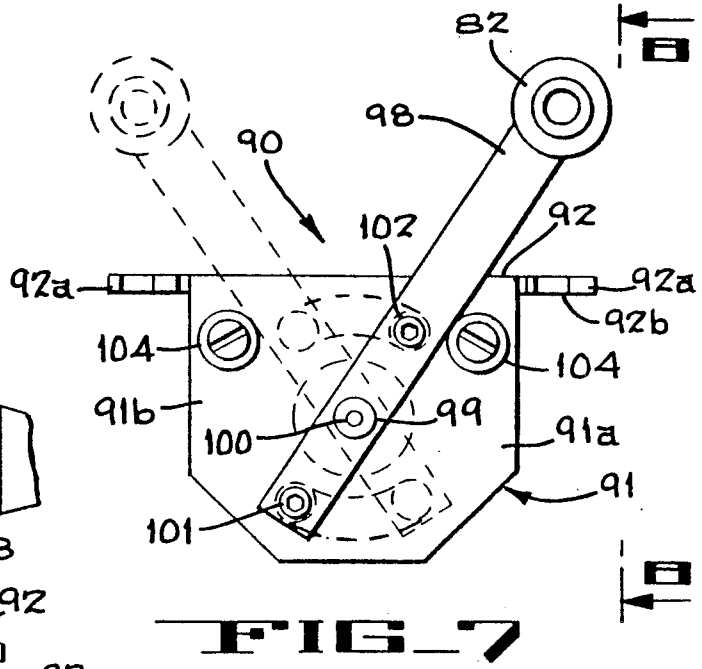
FIG. 7 side elevation of a third embodiment of the mechanism of the present invention.
Figure 8:
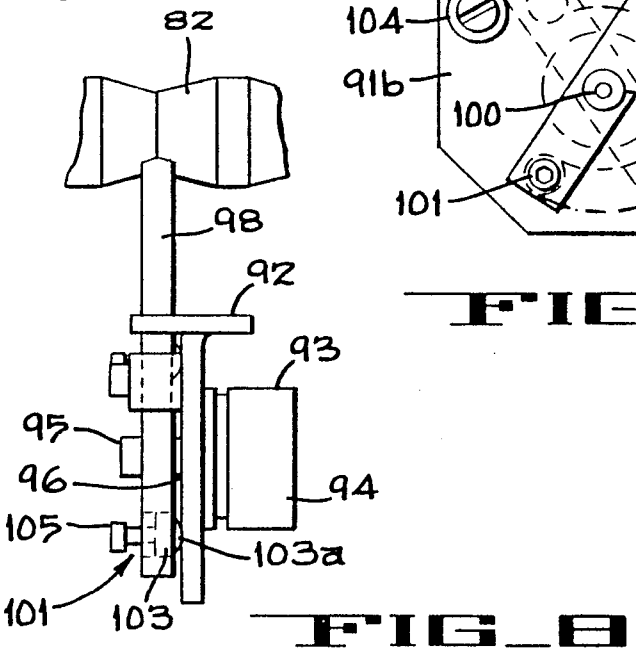
FIG. 8 is a view taken along the lines 8—8 of FIG. 7.

A third embodiment of the present invention is shown in FIGS. 7 and 8. The fader mechanism 90 simply shows that the present invention can be incorporated in a device which uses a single side plate. However, in many respects the fader mechanism 90 is quite similar to the fader mechanism 58 described in the second embodiment. In the fader mechanism 90, a single side plate 91, having a generally rectangular main body portion 91*a*, is folded at its upper end to terminate at an upper flange 92 generally perpendicular to the side plate 91, the upper flange 92 including extensions 92*a* provided at opposite ends. The extensions 92*a* have openings 92*b* therein for receiving suitable fasteners for securing the control mechanism 90 to the associated switcher control panel 12.

Mounted on the side plate 91 is a rotary potentiometer 93. The potentiometer body 94 is held in place on the side plate 91 by means of an appropriate clip (not shown) such as the potentiometer clip 65 shown in FIG. 6. A rotatable potentiometer shaft 95 extends through an opening 96 in the plate 91. Rigidly mounted on the potentiometer shaft 95 is a control lever 98. The control lever 98 is rigidly secured to the shaft 95 at an opening 99 provided in the lever 98. The shaft 95 defines a pivot axis 100 for the control lever 98. Provided at an inner end of the control lever 98 is a first glide member 101. A second glide member 102, provided on the outer end of the control lever 98, is spaced about the same distance from the pivot axis 100 as the glide member 101. Since the glide members 101, 102 are identical except for location, only one of them need be described in detail.

As shown in FIG. 8 the glide member 101 includes a cylindrical element 103, terminating in a conical end 103*a*, abutting one side 91*b* of the side wall 91, the glide member 101 being received for sliding movement in a suitable recess in the control lever 98 and having at an opposite end an adjustable screw 105 which can be threaded into the lever 98 to increase the amount of compression that the glide member 101 exerts on the wall 91*b*. The glide member 101 is shown to have an Allen head construction for easy access by an Allen wrench. Other configurations are possible; for example, a control lever similar to the lever 17 could be substituted for the lever 98. Finally, the mechanism 90 includes a pair of spacers 104 provided adjacent opposite upper edges on the face 91*b* of the plate 91, to set the limits of travel for the control lever 98.

The embodiment shown in FIGS. 7 and 8 also includes a handle 82 mounted at the outer end of the control lever 98 of the control mechanism 90 in a manner similar to the mounting of the handle 82 on the control lever 74 of the control mechanism 58. The face 91*b* of plate 91, which is adjacent to the conical end 103*a* of the glide member 101 is coated with an anti-friction material on which the paths of both glide members 101 and 102 are traced. Although two glide elements 101, 102 are provided in the fader mechanism 90, such mechanism is functional with a single glide element.

The operation of the control mechanism 90 need not be described in detail since it functions similarly to the previously described mechanisms 18 and 58. The mechanism 90 shows that the present invention can include a device with only a single side plate.

Having described a preferred embodiment and an alternative embodiment of the present invention, it is recognized that further embodiments are possible. Accordingly, the claims which follow define the breadth of the present invention.

What is claimed is:

1. A control mechanism including pivotable means frictionally engaged by said mechanism to effect the resistance to movement thereof, said mechanism comprising:

a pair of plates mounted in spaced relation;

pivotable means for supporting a lever mounted to extend outward of the plates, the plates supporting said pivotable means for rotary movement of the lever about an axis extending therebetween;

said lever mounted on said pivotable means; and engaging means mounted on the lever for engaging the plates, said engaging means including at least one glide element disposed between the plates, for relative movement thereto as defined by the movement of the lever; and an adjustment means disposed on the lever for urging said glide element into engagement with the plates to exert a force on the plates which resists the movement of lever, the adjustment means operable to selectively vary the force exerted on the plates by said element, thereby to control the amount of resistance to rotary movement of said lever.

2. A control mechanism as claimed in claim 1 wherein the pivotable means includes a rotatable shaft mounted to define a pivot axis between the two spaced plates.

3. A control mechanism as claimed in claim 2 wherein the lever is rigidly mounted on the rotatable shaft.

4. A control mechanism as claimed in claim 1 wherein the lever includes a handle mounted at an outer end thereof and said lever extends along its axis beyond the rotatable shaft, and the glide element is mounted at an inner end of the lever opposite the handle.

5. A control mechanism as claimed in claim 1 wherein the glide element is mounted on the lever between the pivot axis of the rotatable shaft and an outer end of the lever.

6. A control mechanism as claimed in claim 1 wherein the glide element comprises an elastomeric material.

7. A control mechanism as claimed in claim 6 wherein the glide element includes an anti-friction material.

8. A control mechanism as claimed in claim 1 wherein the engaging means includes an anti-friction material applied to the inner faces of the spaced plates.

9. A control mechanism as claimed in claim 1 wherein at least two spacers separate the spaced plates, such spacers also defining the limits of rotary movement of the pivotable means for the mechanism about its pivot axis.

10. A control mechanism including a pivotable arm frictionally engaged by said mechanism to effect the rate of movement thereof, said mechanism comprising:

a pair of plates mounted in spaced relation;

lever control means for controlling the movement of a lever mounted to extend between the plates, said level control means including pivotable means for supporting the lever for rotary movement about an axis between the plates; said lever control means including movement resisting means mounted on the lever for controlling the resistance to movement of the lever, said resisting means to be urged into engagement with said plates and being to exert a force thereon which resists the movement of the lever, and being selectively axially moveable by said lever control means to adjust the force exerted by said movement resisting means, thereby to control the amount of resistance to rotary movement of said lever.

11. A switcher assembly for manipulating a video signal in which a mixed signal input is applied to a switching matrix to be output therefrom to keyers and signal effect mixers which process the signal output, and a signal selecting device for selectively combining the mixed signal output of the mixers, said signal selecting device including a signal control mechanism having pivotable means frictionally engaged by said mechanism to effect the resistance to movement thereof, said mechanism comprising;

a pair of plates mounted in spaced relation;

pivotable means for supporting a lever mounted to extend between the plates, the plates supporting said pivotable means for rotary movement of the lever about an axis extending therebetween;

engaging means mounted on the lever and cooperative with said pivotable means, said engaging means operative to resist the movement of the lever and including at least one glide element disposed between the plates for relative movement thereto as defined by the movement of the lever; and an adjustment means disposed on the lever for urging said glide element into engagement with the plates to exert a force on the plates which resists the movement of the lever, the adjustment means operable to selectively vary the force exerted on the plates, thereby to control the amount of resistance to rotary movement of said lever.

* * * * *